United States Patent [19]

Nilsson

[11] Patent Number: 4,563,150

[45] Date of Patent: Jan. 7, 1986

[54] ILLUMINATING DEVICE

[76] Inventor: Leif Nilsson, Blåbärsvägen 1, S-260 40 Viken, Sweden

[21] Appl. No.: 577,859

[22] Filed: Feb. 7, 1984

[30] Foreign Application Priority Data

Feb. 17, 1983 [SE] Sweden ..... 8300891

[51] Int. Cl.[4] ..... F23D 3/18

[52] U.S. Cl. ..... 431/320; 431/321; 431/34

[58] Field of Search ..... 431/289, 291, 295, 296, 431/302, 310, 313, 312, 314, 320, 321, 323, 34, 33; 362/161, 204, 234; 126/127, 208, 257, 116 R, 96

[56] References Cited

U.S. PATENT DOCUMENTS

| | | | |
|---|---|---|---|
| Re. 3,315 | 3/1869 | Merrill | 431/313 |
| 71,354 | 11/1867 | Young | 431/313 |
| 95,460 | 10/1869 | Gilman | 431/312 |
| 115,953 | 6/1871 | Ross | 431/313 |
| 150,824 | 5/1874 | Buzby | 431/313 |
| 278,295 | 5/1883 | Tobey | 431/310 |
| 729,542 | 6/1903 | Carson | 431/34 |
| 864,803 | 9/1907 | Schvetz | 431/310 |
| 1,610,301 | 12/1926 | McCloskey | 431/321 |
| 2,022,719 | 12/1935 | Irvine | 431/34 |
| 2,077,129 | 4/1937 | Perkins | 431/313 |
| 2,080,251 | 5/1937 | Buskard | 431/231 |
| 3,081,612 | 3/1963 | Roscouich | 431/321 |
| 3,321,938 | 5/1967 | Bureau | 431/321 |
| 3,885,905 | 5/1975 | Giangiulio | 431/34 |
| 3,905,754 | 9/1975 | Maddestra et al. | 431/310 |
| 4,025,290 | 5/1977 | Giangiulio | 431/321 |
| 4,126,408 | 11/1978 | Cox | 431/320 |
| 4,262,325 | 4/1981 | Garcia | 431/291 |
| 4,496,307 | 1/1985 | Ginardi | 431/34 |

FOREIGN PATENT DOCUMENTS

| | | | |
|---|---|---|---|
| 1030052 | 6/1953 | France | 431/321 |
| 1195918 | 6/1970 | United Kingdom | 431/34 |

*Primary Examiner*—Larry Jones
*Assistant Examiner*—H. A. Odar
*Attorney, Agent, or Firm*—Collard, Roe & Galgano

[57] ABSTRACT

The invention relates to an illuminating device which is operated on an inflammable liquid fuel and which comprises a container (10), a burner (21), and a wick (22) arranged in the burner. The container (10) has provided therein one or more openings (18, 19) for balancing the pressure within the container. In accordance with the invention, the burner (21) is arranged to co-act with a shield (24) which, in a working position, permits the flame to burn freely, while in the event of the position of the device being radically changed is brought into abutment with the free end of the wick (22) and extinguishes the flame.

2 Claims, 3 Drawing Figures

ILLUMINATING DEVICE

The present invention relates to an illuminating device of the kind which is operated on an inflammable liquid fuel and which includes a liquid-fuel container having one or more oxygen-supply openings arranged therein, preferably a container which can be re-filled; a burner; and a wick arranged in said burner, the upper end of which wick preferably projects above the upper, free part of the burner, said liquid-fuel being transported along the wick by capillary action.

An illuminating device of this kind is known from Swedish patent application No. 8204298-7. Among other things, this known device is provided with means which prevents the liquid fuel running from the container, should the illuminating device be tilted or tipped over, i.e. should it be radically disturbed from its normal operation position. The provision of such a safety means, however, cannot exclude the risk of fire should the position of the device be radically changed (the device falls over). In this event, the wick will still take-up fuel, despite the positional change of the device, and the naked flame will always constitute a serious potential fire risk. Even though measures may be taken to prevent fuel from being taken-up by the wick in the event of such radical positional changes of the illuminating device, as proposed in British Pat. No. 1.218.354, the wick is normally so saturated with fuel that it will continue to burn long after the supply of fuel to the wick has ceased. Such radical positional changes of the illuminating device, i.e. should the device be tipped over or should fall, cause the naked flame to be located close to the surface supporting the device, thereby creating a serious fire risk.

The object of the present invention is to improve the safety of such illuminating devices, so that in the event of the device falling over (subjected to a radical change in position), the flame on the wick is extinguished.

This object is realised in accordance with the invention, which is characterized in that the upper part of the burner of an illuminating device of the aforementioned kind is arranged to co-act with a member in a manner such that in the normal operating position of the device the flame is allowed to burn freely, while when the device is subjected to a radical positional change, said body is brought into contact with the wick and/or said upper free end of the wick, to extinguish the flame on said wick.

An embodiment of the present invention will now be described with reference to the accompanying drawing, and further characterizing features of the invention will be made apparent in conjunction therewith.

Figure 1:
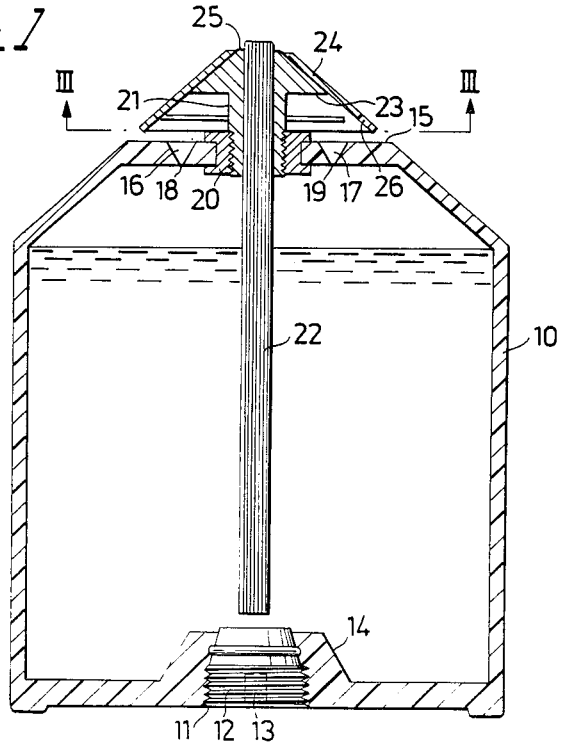
FIG. 1 is a longitudinal sectional view of an illuminating device according to the invention.
Figure 2:
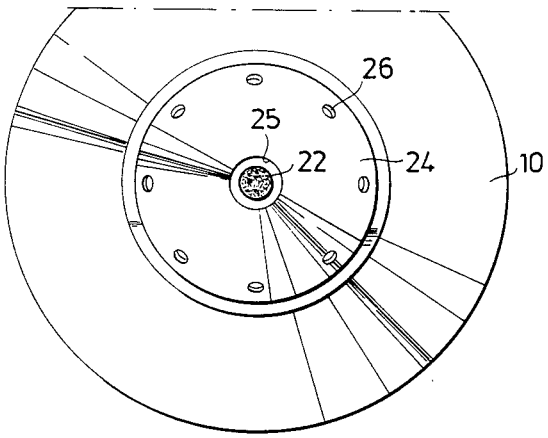
FIG. 2 is a top-plan view of the body illustrated in cross section in FIG. 1.
Figure 3:
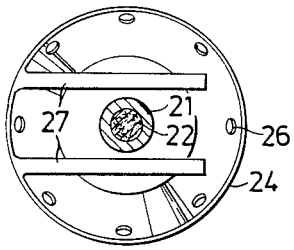
FIG. 3 is a view taken on the line III—III in FIG. 1.

The improved, fluid-operated illuminating device illustrated in FIG. 1 includes a container 10, preferably a container which can be refilled. The container is preferably made of a suitable plastic material, although it may also be made of a metal or metal-alloy material. In the illustrated embodiment, the container has a cylindrical form, with the upper part of the container having the shape of a truncated cone. The floor of the container 10 has arranged therein a through-passing screwthreaded hole 11, Through which a suitable liquid fuel can be introduced into the container. The hole 11 is plugged by means of a screw 12, which has diagonal groove 13. This enables the screw 12 to be readily screwed into and out of the hole 11, with the aid of a screwdriver.

The hole 11 and the screw 12 are accommodated in a thickened, inwardly extending circular part 14, which ensures that the container cannot be overfilled and which avoids both underpressure and overpressure. The level to which the container is filled should lie approximately at that point at which the upper, conical portion of the container merges with the cylindrical part thereof, in order to provide space for the fuel liquid to expand and to avoid any pulsating action of the fuel.

In the illustrated embodiment, the upper planar part 15 of the container 10 is provided with two conical bores 16, 17 which open into the interior of the container 10 in the form of narrow or extremely narrow holes 18, 19. In the centre of the planar part 15 there is arranged a bore in which a hollow, cylindrical burner holder 20, having internal screwthreads, is fixedly arranged. A similar, hollow, cylindrical burner 21 having external screwthreads is detachably arranged in the holder 20. The burner 21 encloses, in a manner known per se, a wick 22, which is passed through the burner 21 and the upper free end of which is arranged, in its normal position, to project somewhat above the upper free part of the burner 21. As will be understood, in order to utilize the capillary action of the wick 22, said wick must be in contact with the liquid fuel in the container 10.

The purpose of the holes 18, 19 is to ensure the necessary venting of the container and also to ensure that the interior of the container receives the necessary oxygen. When the liquid fuel expands, the holes 18, 19 serve as vents, while in the event of an underpressure in the container 10, said means serve to supply oxygen for balancing the pressure. The diameter of the holes 18, 19 is chosen so that if the container topples over (its position is radically changed) the intrinsic surface tension of the liquid fuel will prevent the fuel from running through the holes 18, 19. Consequently, no check valves or similar mechanical devices are required.

Arranged on the upper part of the burner 21 is an annular and conical flange 23, the undersurface of which is spaced from the upper, horizontal part 15 of the container 10.

An annular and conical shield 24, provided with a central opening 25, is arranged to rest loosely on the upper, conical part of the burner 21. The diameter of the opening 25 is somewhat larger than the diameter of the wick 22. The lower part of the shield 24 is located at a distance from the container part 15. In addition, the shield 24 is provided with a plurality of circumferentially distributed openings 26, for conducting away heat. Arranged on the undersurface of the shield 24, one on each side of the central opening 25, are tongues 27 which, in the working position of the shield 24, abut either side of the flange 23 of the burner 21, within the radius of said flange. The tongues 27 are fixedly connected to the shield 24 at only one end so as to enable the shield 24 to be removed when required, by bending away the free ends of said tongues, said tongues being out of contact with the opposing surface of the shield 24.

Should the container 10 topple over, no liquid fuel will run out through the vent holes 18, 19, for the reasons aforementioned. Moreover, should the container topple, the shield 24 will slide on the conical surface of the burner 21, whereupon the opening 25 will be displaced laterally and the shield will come into abutment with the wick, causing the flame to be extinguished, mainly through lack of oxygen. During this displacement of the shield, the tongues 27, together with the axial part of the burner 21 beneath the flange 23, will form a guide and a stop means which prohibit the shield from moving laterally. The flange 23 prevents the shield 24 from moving axially to an extent greater than the distance formed between the tongues 27 and the undersurface of the flange 23.

A particular purpose of the illustrated and described embodiment is to enable a plastic container to be used safely. The shield 24 is not therefore solely a safety means serving to obviate a fire risk should the illuminating device topple, but also serves as a heat-conducting means.

An illuminating device constructed in accordance with the invention fulfills all conceivable safety requirements, and can also be manufactured at a reasonable price. The lack of any mechanical, complex arrangement means that the need for maintenance and repair work is practically non-existent.

I claim:

1. An illuminating device comprising a container adapted to be filled with an inflammable liquid and having a flat top and a flat bottom, means in said bottom permitting the filling of said container with fuel up to a predetermined fuel level and securing a minimum air filled space in the container above said level, said filling means comprising a central axial boss protruding into the container a predetermined distance and having a threaded fuel filling bore therethrough, a screw adapted to be screwed into said bore to close the container upon the filling of the same, said air space through at least one opening communicating with the ambient atmosphere in order to equalize the pressure in said space irrespective of fuel expansion and retraction in said container, said at least one opening being so dimensioned that the fuel owing to its intrinsic surface tension only is prevented from escaping through said opening even if the device is tilted or turned upside down, whereas the passage of air therethrough is always secured, a burner having a frustoconical tip with its smaller end turned upwards and its other end provided with a central depending shaft, said shaft having its free end screw threaded and having an axial channel containing a wick, the upper end of which protrudes somewhat above the upper end of the frustoconical tip and its lower end being immersed into the liquid fuel in order to transport fuel by capillarity action by said wick up to a flame site at said tip, an annular burner holder arranged centrally in said flat top of the container and having a central axial threaded hole therethrough adapted to receive the free threaded end of the shaft of said burner, a flame snuffer means allowing the flame to burn freely when the container is positioned upright but arranged to extinguish said flame if the container is excessively tilted or even inverted, said snuffer means being a conical ring resting loosely upon said frusto conical burner tip and having the same taper as said tip, the top opening of said ring having a slightly greater diameter than said smaller end of said burner tip and the bottom opening of said ring having a greater diameter than the lower end of said burner tip, the lower edge of said ring in the upright position of the illuminating device being spaced from said flat top of the container, and mounting means for mounting said snuffer means upon the burner tip in such a way that it is capable of restricted movements in the axial direction of the burner and in right angled direction thereto when said device is tilted or inverted in order to contact and cover the flame site, said mounting means comprising resilient and mutually parallel tongues projecting diagonally from the inner surface of said conical ring and having their free ends somewhat spaced from an opposite part of the inner surface of said conical ring, said tongues furthermore being vertically spaced from the lower end side of the burner tip and from an under edge of said ring and from said flat top of the container and wherein said tongues are guided one on each side of the shaft of said burner with a slip fit thereto, the lower end of said frustoconical tip serving as a stop for the vertical movement of the conical ring and said spacing to said opposite part making the detachment of the ring from the burner possible by means of an inclined pulling force exerted upon said ring to spread out the free ends of the resilient tongues and bend them downwards to give sufficient room for the passage of the burner tip between said free ends and the under edge of the conical ring in order to make the burner accessible for detachment for exchange of wick.

2. An illuminating device as claimed in claim 1, wherein said conical ring has openings uniformly spaced around its periphery for heat dissipation.

* * * * *